US007000736B2

(12) United States Patent
Rice et al.

(10) Patent No.: US 7,000,736 B2
(45) Date of Patent: Feb. 21, 2006

(54) ELEVATOR PIT SET ASSEMBLY

(75) Inventors: Kevin M. Rice, Gardners, PA (US); William R. Eaton, Jr., Dover, PA (US)

(73) Assignee: Inventio AG, Hergiswil (CH)

( * ) Notice: Subject to any disclaimer, the term of this patent is extended or adjusted under 35 U.S.C. 154(b) by 204 days.

(21) Appl. No.: 10/314,573

(22) Filed: Dec. 9, 2002

(65) Prior Publication Data

US 2004/0129505 A1 Jul. 8, 2004

(51) Int. Cl.
*B66B 7/02* (2006.01)

(52) U.S. Cl. ..... 187/408; 187/406; 187/254

(58) Field of Classification Search ..... 187/250, 187/254, 264, 266, 406, 408; 248/200, 300, 248/316.8, 637, 678
See application file for complete search history.

(56) References Cited

U.S. PATENT DOCUMENTS

| | | | | |
|---|---|---|---|---|
| 5,899,300 | A * | 5/1999 | Miller et al. | 187/266 |
| 2004/0112681 | A1 * | 6/2004 | Kato et al. | 187/254 |
| 2004/0154875 | A1 * | 8/2004 | Bass et al. | 187/406 |

FOREIGN PATENT DOCUMENTS

| | | | |
|---|---|---|---|
| EP | 0 849 209 | A1 | 6/1998 |
| JP | 2001-226053 | A | 8/2001 |
| JP | 2001-335255 | A | 12/2001 |
| WO | WO 01/79105 | A1 * | 10/2001 |

* cited by examiner

*Primary Examiner*—Eileen D. Lillis
*Assistant Examiner*—Thuy V. Tran
(74) *Attorney, Agent, or Firm*—Schweitzer Cornman Gross & Bondell LLP

(57) ABSTRACT

An elevator pit assembly for mounting and supporting car and counterweight rails, preferably in a tri-rail configuration, has first and second plates joinable in alternative right-angle configurations. The first plate accommodates a rail assembly having car and counterweight rails and a spaced lone counterweight rail, while the second plate accommodates a lone car rail. The plates may be bolted together through flanges.

6 Claims, 3 Drawing Sheets

ELEVATOR PIT SET ASSEMBLY

The present invention relates to a new and improved pit set assembly to be used in elevator constructions.

BACKGROUND OF THE INVENTION

A typical elevator installation includes an elevator car connected by cables to a traction machine mounted in a machine room above the top of the elevator hoistway or, in more contemporary designs, mounted in the hoistway itself at the top of a rail stack. A counterweight is typically provided for the elevator, and rails extend along the length of the hoistway to guide the car and counterweight.

Below the hoistway is located an elevator pit in which the mounting system for the rails is located. Conventionally, the pit plates for support of the individual rail elements and the like are positioned individually. It is thus necessary that they be arranged and mounted with a great degree of care such that, as a group, they function correctly and properly.

Because of the independent nature of the various support and attachment elements, it has heretofore been difficult to achieve proper alignment of the elements. It is accordingly the purpose of the present invention to provide a pit set assembly capable of supporting guide rails as well as elevator buffer assemblies in a simplified manner and with a high degree of accuracy and precision.

BRIEF DESCRIPTION OF THE INVENTION

In accordance with the foregoing and other objects and purposes, an elevator pit set assembly in accordance with the present invention, preferably for use in connection with rail systems in a tri-rail configuration, comprises first and second pit plates upon which are the guide rails and buffer units are to be mounted. The plates are configured to be joinable together in a precise right angle configuration, and include pre-established mounting points for the rails and buffers. Integral bolting tabs are provided to permit the plates to be joined together. In a preferred embodiment, multiple bolting tabs are provided to allow the plates to be assembled together both in left and right-handed configurations.

BRIEF DESCRIPTION OF THE DRAWINGS

A fuller understanding of the present invention will be achieved upon consideration of the following detailed description of a preferred, but nonetheless illustrative embodiment thereof, when reviewed in conjunction with the annexed drawings, wherein.

DETAILED DESCRIPTION OF THE INVENTION

Figure 1:
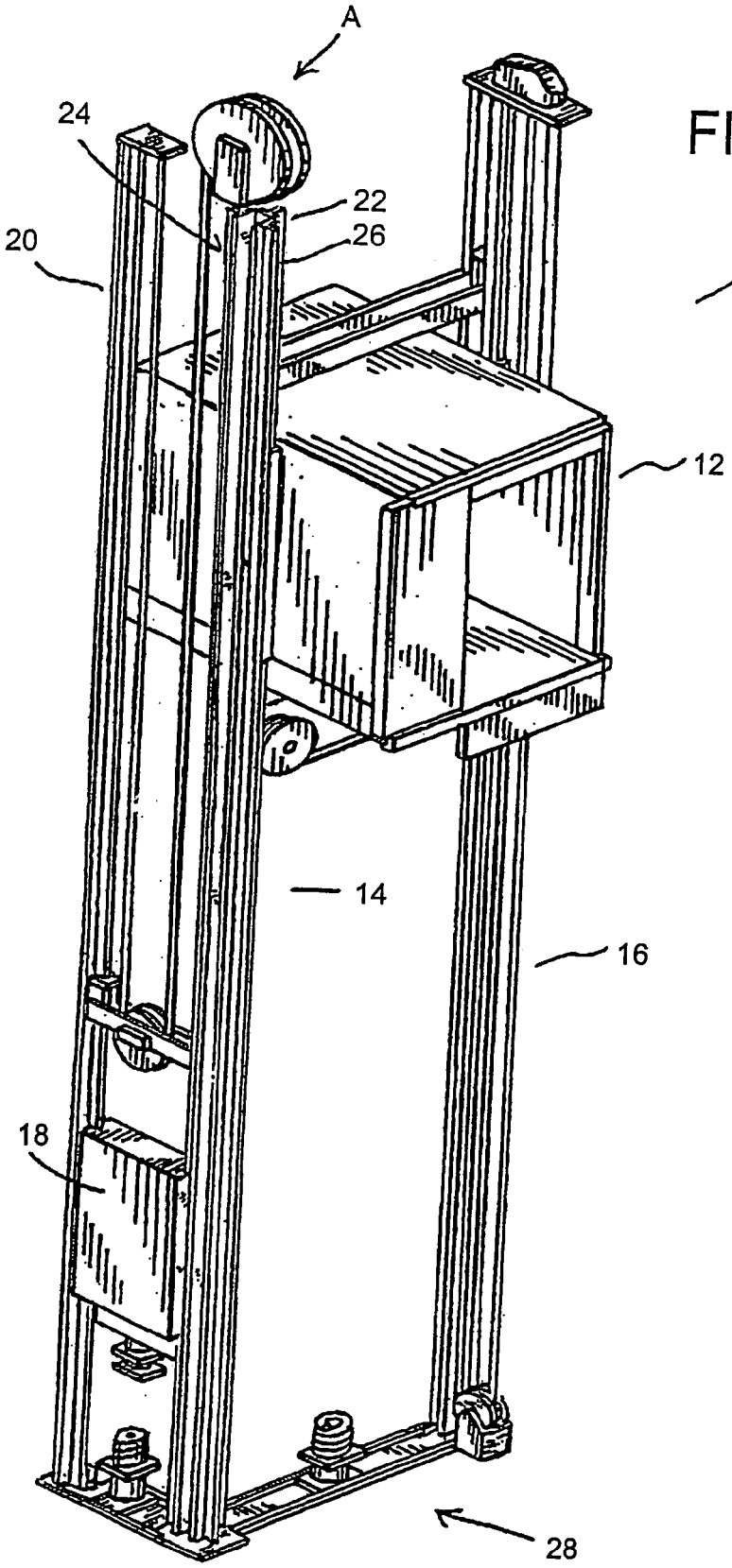
FIG. 1 is a perspective view of an elevator construction utilizing the invention.

FIG. 1 depicts an elevator construction 10 of a "tri-rail" type construction in which the elevator cab 12 rides between a tri-rail rail assembly 14 and an opposed lone car rail 16. The elevator counterweight 18 rides between the tri-rail rail assembly 14 and a lone counterweight rail 20. The tri-rail assembly 14 includes a car rail 22, a counterweight rail 24, and a machine installation tool rail 26 that, along with the car and counterweight rails 22, 24, support a top-mounted drive machine shown generally at location A. The three rails are interconnected to form a rigid, three-sided assembly. To support and position the rails in the shaft, the tri-rail assembly, lone car rail and counterweight rail are fastened to the inventive pit set assembly 28 of the present invention (see FIG. 4) which is rigidly mounted to the floor of the elevator pit and which allows the rails to be accurately and precisely positioned and aligned. Such alignment is required to insure that both the elevator and counterweight travel freely and smoothly during elevator operation.

Figure 2:
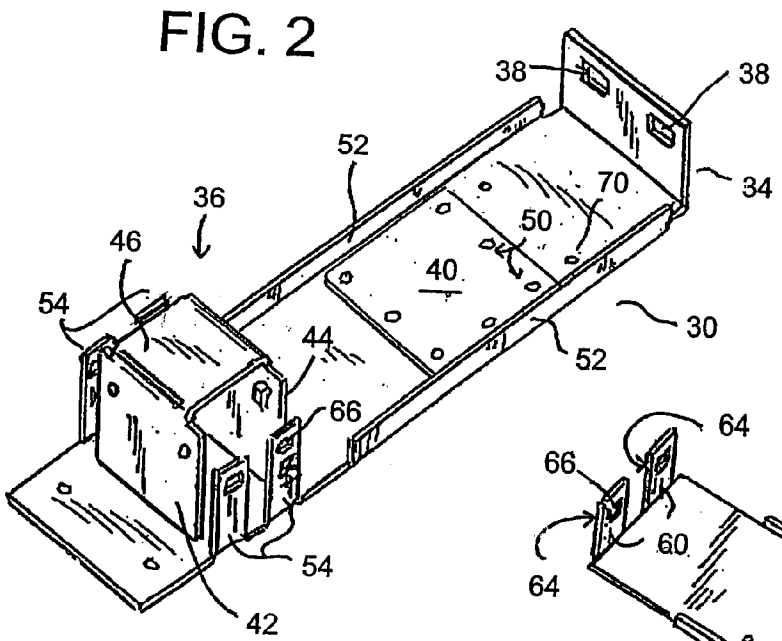
FIG. 2 is a perspective view of a first pit plate of the pit assembly.
Figure 3:
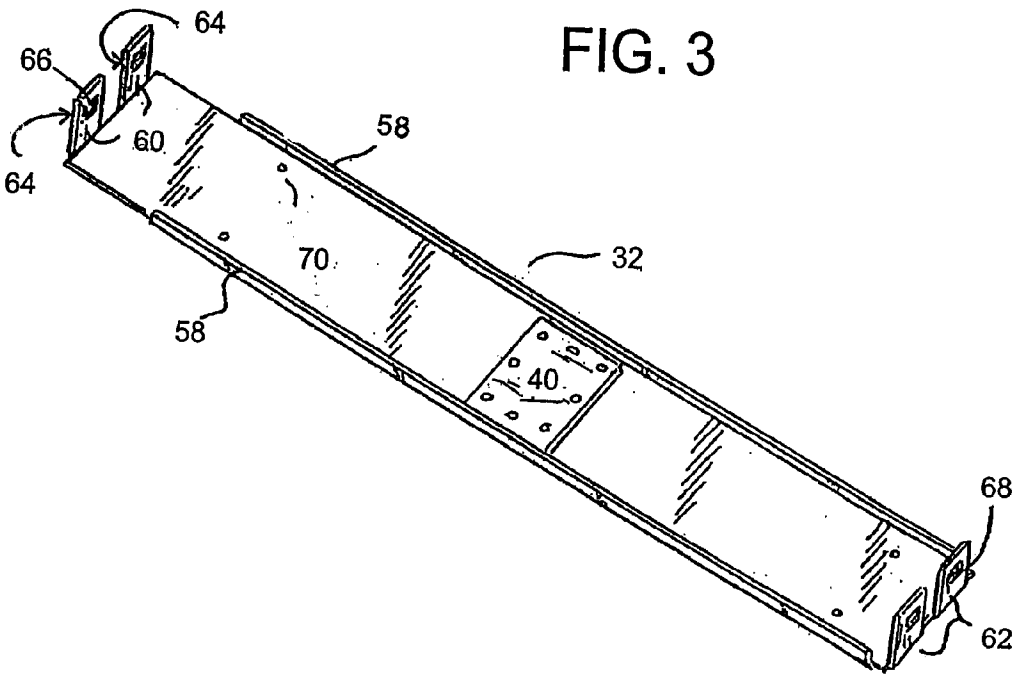
FIG. 3 is an elevation view of a second, complimentary pit plate thereof.
Figure 4:
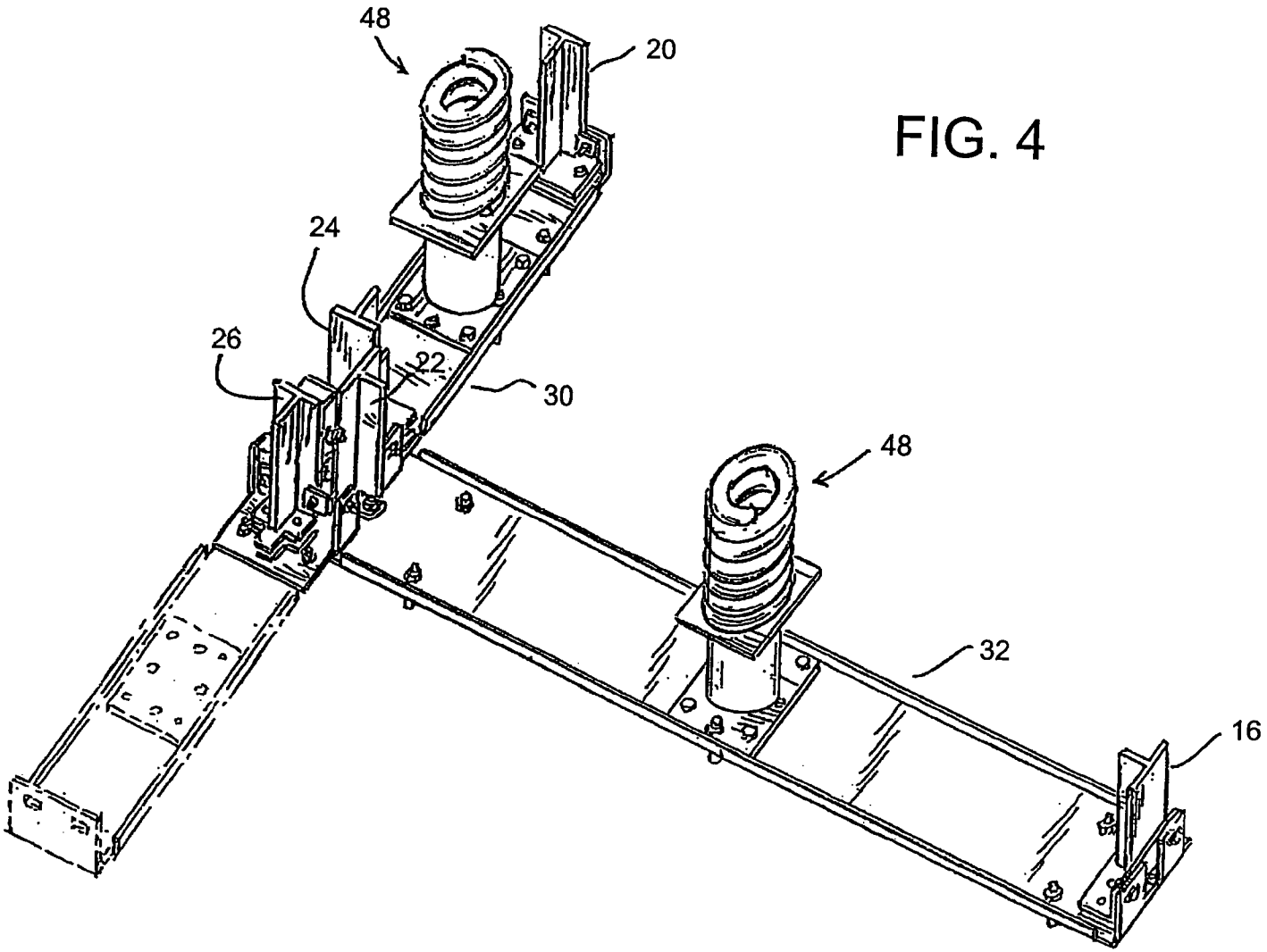
FIG. 4 is perspective view of the assembled construction, showing the lower end of the attached rails.

As further depicted in FIGS. 2–4, the elevator pit assembly includes a counterweight pit plate 30 designed to accommodate the tri-rail assembly 14 and lone counterweight rail 18, located on one side of the shaft, and a car pit plate 32 which precisely aligns with the counterweight pit plate and which supports, at its opposite end, the lone car rail 16 at the opposite side of the shaft.

Counterweight plate 30 is of elongated construction, having an upwardly-extending vertical mounting flange 34 at a first end and a tri-rail mounting assembly 36 proximate a second end. The mounting flange 34 is constructed and dimensioned to accept the lower end of lone counterweight rail 18, which may be mounted thereto by bolts through mounting bores 38 with the bottom end of the rail resting on the counterweight plate. The tri-rail mounting assembly 36 preferably comprises a pair of spaced upright mounting flanges 42, 44 to respectively mount the machine installation tool rail and counterweight rails 22, 24, the flanges being joined at their upper ends by transverse member 46. Preferably, flanges 42, 44 and transverse member 46 may be formed as a unitary inverted U-shaped member, welded or otherwise rigidly mounted to the plate 30.

Located between flange 34 and tri-rail mounting assembly 36 is buffer plate 40, which is similarly mounted to the counterweight pit plate 30 and serves as a pad for attachment of a buffer, such as spring buffer 48, as depicted in FIG. 4. A series of mounting bores 50 may be provided to allow proper affixation of the buffer. The intermediate side edges 52 of the counterweight pit plate between flange 34 and tri-rail mounting assembly 36 may be folded at a 90 degree angle to the main portion of the plate to provide further rigidity for the plate.

In order to allow precise interconnection between the counterweight and car pit plates, the counterweight pit plate 30 is provided with first and second pairs of joining flanges 54, located on opposed sides of the plate adjacent to the tri-rail mounting assembly 36. Each of the joining flanges 54 has an outwardly-directed face or surface 56 which is located to be parallel with the main longitudinal axis of the counterweight pit plate.

Car pit plate 32 is also of extended length, has upturned side edge portions 58 and is designed and constructed to accept the lone car rail 16 at a first end. The plate is also adapted to join to the counterweight pit plate 30 in a precise, right-angle configuration, thus insuring that the tri-rail rails, lone counterweight rail, and lone car rail are precisely located and positioned with respect to each other.

To accomplish this end, the car pit plate 32 is provided with a pair of car rail mounting flanges 62 at its first end, and a pair of plate joining flanges 60 at its second end. The plate joining flanges 60 extend upwardly at a precise right angle to the plane and major longitudinal axis of the car pit plate 32 and are provided with carefully milled surfaces 64 which establish the desired right angle relationship between the counterweight and car pit plates. Each of the joining flanges 60, along with the joining flanges 54 on counterweight pit plate 30, are provided with mounting bores 66 which allow the joining flanges, and thus the pit plates, to be rigidly joined together into the desired L-shaped configuration as depicted in FIG. 4.

The car rail mounting flanges 62 are similarly provided with bores 68 to accommodate mating bores at the lower end of the lone car rail 16. A buffer mounting plate 40 is located along the length of the car pit plate 32, providing a mount for a second buffer 48.

Because of the symmetrical nature of the joining flanges 54 along the opposed sides of counterweight pit plate 30, the two pit plates may be joined together in both "right-handed" and "left-handed" configurations, as suggested by FIG. 4. This allows the pit assembly to be utilized in a variety of pit and shaftway constructions. Accurate and precise alignment of the tri-rail, car and counterweight rails is insured by the precise and totally repeatable joining of the two pit plates together whereby the spacing and positioning of the rail mounting flanges, and thus the rails themselves, are insured. The plates and the fittings associated therewith may be manufactured of any appropriate material, such as steel, cast iron, or aluminum, as appropriate, plate bores 70 being provided to allow mounting bolts or the like to rigidly fasten the plates to the pit floor in the proper alignment.

We claim:

1. A elevator pit assembly for use with an elevator construction having a rail assembly including car and counterweight rails, a spaced lone car rail and a spaced lone counterweight rail, the car rails and the counterweight rails being aligned in a pair of right angle planes, the pit assembly comprising:

a first pit plate having means for mounting an end of the rail assembly and the lone counterweight rail thereto; and a second pit plate having means for mounting an end of the lone car rail thereto;

the first pit plate having plate mounting means located on opposed side edges thereof, the second pit plate having plate mounting means located on opposed ends thereof, the plate mounting means of the first and second pit plates being adapted and constructed to be joined together in a manner whereby the first and second plates can be positioned to form alternative right-angle constructions upon a pit floor;

the means for mounting the end of the rail assembly and the lone counterweight rail thereto comprising an inverted u-shape flange extending upwardly from the first pit plate.

2. The elevator pit assembly of claim 1 wherein the rail assembly includes a machine installation tool rail the means for mounting the end of the rail assembly includes means for supporting the machine installation tool rail.

3. The elevator pit assembly of claim 1 wherein the plate mounting means each comprise a flange having an exterior face adapted to mate with an exterior face of the other pit plate mounting means in a manner whereby the respective pit plates are maintained in a right-angle construction.

4. The elevator pit assembly of claim 1 wherein the pit plate mounting means of the first pit plate are located on opposite side edges of the pit plate adjacent the u-shape flange.

5. The elevator pit assembly of claim 1 further wherein each of the pit plates further includes buffer mounting means thereon.

6. The elevator pit assembly of claim 1 wherein side edge portions of the first and second pit plates each form a right angle to a pit plate main surface.

* * * * *